US007504133B2

(12) United States Patent
Cuyler et al.

(10) Patent No.: US 7,504,133 B2
(45) Date of Patent: Mar. 17, 2009

(54) METHOD OF MANUFACTURING A TRUCK BED LINER WITH A REUSABLE MASKING DEVICE

(75) Inventors: Brian B. Cuyler, Oxford, MI (US); Darren Womack, Windsor (CA); Richard Dumbleton, Northville, MI (US); Blaine Bradley, Madison, MS (US)

(73) Assignees: Nissan Technical Center North America, Inc., Farmington Hills, MI (US); Nissan North America, Inc., Franklin, TN (US)

( * ) Notice: Subject to any disclaimer, the term of this patent is extended or adjusted under 35 U.S.C. 154(b) by 93 days.

(21) Appl. No.: 11/522,519

(22) Filed: Sep. 18, 2006

(65) Prior Publication Data

US 2007/0200383 A1 Aug. 30, 2007

Related U.S. Application Data

(62) Division of application No. 10/339,677, filed on Jan. 10, 2003, now abandoned.

(60) Provisional application No. 60/346,889, filed on Jan. 11, 2002.

(51) Int. Cl.
*B05D 1/32* (2006.01)

(52) U.S. Cl. ..... 427/282; 427/284

(58) Field of Classification Search ..... 427/282, 427/284

See application file for complete search history.

(56) References Cited

U.S. PATENT DOCUMENTS

| | | | |
|---|---|---|---|
| 2,796,041 | A | 6/1957 | Banzhof, Jr. |
| 2,826,328 | A | 3/1958 | Moen et al. |
| 2,916,396 | A | 12/1959 | Perrenod |
| 3,170,810 | A | 2/1965 | Kagan |
| 3,661,622 | A | 5/1972 | Rogers |
| 3,667,988 | A | 6/1972 | Horiki |
| 4,071,944 | A | 2/1978 | Chuss et al. |
| 4,122,225 | A | 10/1978 | Holmstrom et al. |

(Continued)

FOREIGN PATENT DOCUMENTS

| | | |
|---|---|---|
| FR | 2586926 | 9/1985 |

(Continued)

OTHER PUBLICATIONS

Boxxliner® Spray on Truck Bed Liners, www.polycoatings.com/boxxliner.html, 2 pages, printed Jun. 17, 2003.

(Continued)

*Primary Examiner*—Frederick J Parker
(74) *Attorney, Agent, or Firm*—Foley & Lardner LLP

(57) ABSTRACT

A method of manufacturing a bed liner for a truck bed. The method comprises providing a truck bed, applying a masking device to an orifice in the truck bed, retaining the masking device in the orifice by inserting a portion of the masking device into the orifice, applying a coating of truck bed liner material to the truck bed, and removing the masking device. After removing the masking device, a region of the truck bed surrounding the orifice is free of the truck bed liner material. The orifice may include a nut. A portion of the masking device can be inserted into the nut. The masking device may include a clip.

11 Claims, 8 Drawing Sheets

U.S. PATENT DOCUMENTS

| | | | | | |
|---|---|---|---|---|---|
| 4,586,601 | A | | 5/1986 | Hodlewsky | |
| 4,634,512 | A | | 1/1987 | Allen et al. | |
| 4,791,168 | A | | 12/1988 | Salatin et al. | |
| 4,879,158 | A | * | 11/1989 | Horiki et al. | 428/159 |
| 5,084,521 | A | | 1/1992 | White | |
| 5,193,716 | A | | 3/1993 | Horiki et al. | |
| 5,254,395 | A | | 10/1993 | Hodnett, III | |
| 5,270,085 | A | | 12/1993 | Horiki et al. | |
| 5,328,723 | A | | 7/1994 | Horiki et al. | |
| 5,576,072 | A | | 11/1996 | Hostettler et al. | |
| 5,702,774 | A | | 12/1997 | Griffin et al. | |
| 5,768,784 | A | | 6/1998 | Williams et al. | |
| 5,786,028 | A | * | 7/1998 | Cantwell | 427/282 |
| 5,788,774 | A | | 8/1998 | Mccumiskey et al. | |
| 5,814,398 | A | | 9/1998 | Kronz et al. | |
| 5,830,307 | A | | 11/1998 | Hiruta et al. | |
| 5,858,508 | A | | 1/1999 | Sturtevant et al. | |
| 5,885,318 | A | | 3/1999 | Shimizu et al. | |
| 5,885,662 | A | | 3/1999 | Gardner, Jr. | |
| 5,885,667 | A | | 3/1999 | Calfat | |
| 5,925,466 | A | | 7/1999 | Burton | |
| 5,962,144 | A | | 10/1999 | Primeaux, II | |
| 5,962,574 | A | | 10/1999 | Jackson et al. | |
| 5,965,256 | A | | 10/1999 | Barrera | |
| 5,994,664 | A | | 11/1999 | Anderton et al. | |
| 6,017,617 | A | | 1/2000 | Gardner, Jr. | |
| 6,025,045 | A | | 2/2000 | Langeman | |
| 6,034,166 | A | | 3/2000 | Jackson et al. | |
| 6,060,117 | A | | 5/2000 | Pergande et al. | |
| 6,126,999 | A | | 10/2000 | Tomasino et al. | |
| 6,129,041 | A | | 10/2000 | Maiworm et al. | |
| 6,174,932 | B1 | | 1/2001 | Pachl et al. | |
| 6,190,589 | B1 | | 2/2001 | Bryant et al. | |
| 6,207,226 | B1 | | 3/2001 | Igarashi | |
| 6,221,439 | B1 | | 4/2001 | Negele et al. | |
| 6,221,441 | B1 | | 4/2001 | Emch | |
| 6,231,931 | B1 | | 5/2001 | Blazey et al. | |
| 6,238,748 | B1 | | 5/2001 | Nakamura et al. | |
| 6,242,055 | B1 | | 6/2001 | Neumann et al. | |
| 6,248,173 | B1 | | 6/2001 | Dixon | |
| 6,266,882 | B1 | | 7/2001 | Ali et al. | |
| 6,303,185 | B1 | | 10/2001 | Banning et al. | |
| 6,303,209 | B1 | | 10/2001 | Kobayashi | |
| 6,303,665 | B1 | | 10/2001 | Helber et al. | |
| 6,306,502 | B1 | | 10/2001 | Fukushima et al. | |

FOREIGN PATENT DOCUMENTS

| | | | |
|---|---|---|---|
| JP | 357009363 | A | 1/1982 |
| JP | 4-099252 | U | 8/1992 |
| JP | 4-218443 | A | 8/1992 |
| JP | 5-025748 | Y2 | 6/1993 |

OTHER PUBLICATIONS

Diamond Liners, Inc., "Permanent Sprayed-On Protection Spray . . . ", www.diamondliners.com/advantages.html, 5 pages, printed Jun. 17, 2003.

Line-X, "Line-X Spray on Truck Bed Liners", www.goline-x.com/index.asp, 7 pages, printed Jun. 17, 2003.

Perma-Tech, "Perma-Tech Sprayed-On Technology", www.perma-tech.com/sprayon/truckap.html, 6 pages, printed Jun. 17, 2003.

Rhino Linings, "Rhino Linings Sprayed-On Truck Bed Liner", www.rhinolinings.com/ , 6 pages, printed Jun. 17, 2003.

ArmorThane, "ArmorThane Offers a Spray on Polyurethane Bedliner Coating for Your Truck", www.armorthane.com/ , 7 pages, printed Jun. 17, 2003.

* cited by examiner

METHOD OF MANUFACTURING A TRUCK BED LINER WITH A REUSABLE MASKING DEVICE

CORRESPONDING RELATED APPLICATIONS

The present application is a divisional of U.S. application Ser. No. 10/339,677 (now abandoned), filed Jan. 10, 2003, the entire contents of which are incorporated herein by reference. The Applicants claim the benefit of and priority to U.S. Provisional Patent Application No. 60/346,889 filed on Jan. 11, 2002, the entire contents of which are incorporated by reference herein in its entirety.

BACKGROUND OF THE INVENTION

A. Field of the Invention

The invention relates generally to vehicle bed liners, more particularly, to sprayable bed liners and methods of manufacturing the same.

B. Description of the Related Art

As a way to protect pickup truck beds, a sprayable, rapidly curing, polymer coating is applied to the painted or e-coated surface. See, for example, U.S. Pat. Nos. 5,925,466 and 5,814,398 which are incorporated by reference herein in their entirety. These sprayed on linings provide several advantages over the widely used preformed plastic liners. The preformed plastic linings generally do not form a tight seal between the truck bed and the liner, which allows water and dirt to intrude in between the liner and the bed. Water and dirt buildup can eventually lead to abrasion of the paint and corrosion of the truck bed. Sprayed on liners (e.g., polymer coatings) adhere to the surface of the truck bed, effectively sealing it from water and dirt. Rapid curing sprayed on liners allow the product to be sprayed on vertical and other non-horizontal surfaces. Areas that do not require the sprayed on liner, or must not have any build up of the sprayed on liner (e.g., cab rear glass window, tie downs, etc.), however, require trimming or masking those areas to prevent the sprayed on liner from adhering to those surfaces.

Trimming of the cured product is difficult and time consuming. Trimming with a sharp blade or similar device can score through the paint or e-coat applied to the pickup bed. Scoring allows moisture to be in contact with the bare metal substrate which would be a prime site for corrosion to begin. Furthermore, as sprayed on liner materials tend to cure to a hard tough coating, trimming generally must be performed before the sprayed on liner fully cures.

Masking off areas to prevent the sprayed on liner from adhering to those surfaces also has its difficulties. At least partially due to the fast curing nature of sprayed on liners, if masking tape is removed too long after the bed liner is sprayed, the cured layer on top of the tape will effectively prevent it from being removed. If the masking tape is removed before the material is fully cured, a jagged appearance along the edge of the sprayed on liner can result.

One solution to this problem is to mask with edge trimming tape. See, for example, U.S. Pat. No. 6,025,045 which is incorporated by reference herein in its entirety. Edge trimming tape contains a wire which, when pulled up through a semi-cured material, cuts the material and leaves a clean edge. Edge trimming tape works well for long, straight, and semi-straight areas, but holes and odd shapes are problematic due to their shape and size. Also, because the edge trimming tape needs to be pulled up before the sprayable bed liner is fully cured, there is a finite period of time that the de-masking can take place. If the edge trimming tape is left until the coating is fully cured, the removal of the tape is difficult if not impossible.

Moreover, to provide clean edges for a desirable appearance, trimming with a blade, conventional masking, and masking with edge trimming tape, all need to be done shortly after the material is sprayed (i.e., prior to substantial curing).

To date, substantially all of the sprayable bed liners have been done by after market shops. Companies such as Rhino Linings® spray bed liners one truck bed at a time, with the masking, spraying and de-masking taking several hours. Using this process in an original equipment manufacturer (OEM) manufacturing plant, however, is not feasible due to the considerable amount of time and labor required. Thus, to apply a sprayable bed liner in an automobile manufacturing plant, a need exists for a method of masking or trimming that is fast to apply, flexible enough to be able to be removed after curing, and leaves a good appearance.

The present invention is directed to overcoming or at least reducing the effects of one or more of the problems set forth above and other problems in the prior art.

SUMMARY OF THE INVENTION

According to one embodiment of the present invention, a masking device is provided with a plug including at least one protruding portion, wherein the protruding portion is adapted to engage at least one of an orifice and a deformation in a substrate.

According to another embodiment of the present invention, a truck bed is provided with a bed, at least one bushing adjacent to the bed, and a coating applied over the bed, wherein the coating is applied such that the coating retains the bushing adjacent to the bed.

According to another embodiment of the present invention, a method of manufacturing a truck bed liner is provided. The method comprises the steps of positioning at least one masking plug having a protruding portion into an orifice of the truck bed, applying a bed liner material onto the truck bed, and removing the at least one masking plug.

According to another embodiment of the present invention, a masking device is provided with a plug adapted to cover at least one of an orifice and a deformation in a substrate, and a clip coupled to the plug, the clip being adapted to releasably retain the plug on the substrate.

According to another embodiment of the present invention, a masking device is provided with a base portion adapted to cover an area of a substrate, and a key lock adapted to releasably lock the base portion to the substrate.

According to another embodiment of the present invention, a masking device is provided with means for masking at least one of an orifice and a depression formed on a substrate, and means for releasably positioning the means for masking on the substrate.

According to another embodiment of the present invention, a masking device for masking a region on a substrate is provided with a plug including at least one protruding portion, wherein the plug is configured to overhang a portion of the substrate so as to create a tapered edge of a material sprayed on the substrate.

DETAILED DESCRIPTION OF SPECIFIC EMBODIMENTS

Figure 1A:
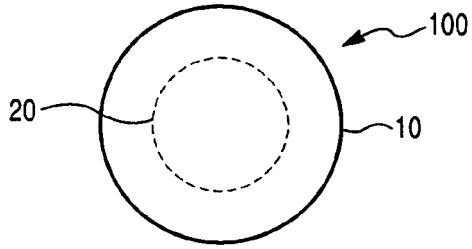
FIG. 1A-1D are views of a masking device according to one embodiment of the present invention.

Reference will now be made in detail to presently preferred embodiments of the invention. Wherever possible, the same reference numbers will be used throughout the drawings to refer to the same or like parts.

According to one aspect of the present invention, as a way to mask channels, holes and other areas of a vehicle, to which a sprayable bed liner material is to be applied, a fast, reusable, and effective method has been developed. The method employs a magnetic material covered with Teflon, or other low surface energy material. The shape of the piece is such that it can be located easily before the material is sprayed, and removed after, revealing a clean surface with no bed liner material. The low surface energy of the Teflon, or similar material, does not allow the sprayable bed liner to wet then bond to it, thus making removal of the masking plug easy. A magnetic core of the masking plug keeps it fixed in position during the spraying of the bed liner material. Because the design does not allow the sprayable material to overlap onto it, it can be removed after the material has cured.

A first embodiment of the present invention is shown in the views of FIG. 1 (i.e., FIG. 1A-1D). According to this first embodiment, a masking device 100 comprises a masking plug 10 and a protruding portion 30 for locating the masking plug 10 on a substrate (not shown) such as a metal truck bed. As would be readily apparent to one skilled in the art after reading this disclosure, the masking plug 10 can take on any number of shapes or designs (e.g., plug 410 in FIG. 4, plug 810 in FIG. 7, plug 910 in FIG. 8, etc.), thereby facilitating the use for masking complex shaped areas which could not be done easily with conventional techniques.

Preferably, the masking plug 10 comprises and/or is coated with a material having a substantially low surface energy. The masking plug 10 can be made from a wax, chrome plating on a metal substrate, polyurethane, rubber, or other materials as would be readily apparent to one skilled in the art. Teflon (polytetrafluoroethylene), polypropylene, polyester, polystyrene, polycarbonate, nylon, PVC, ABS, polyethylene, fluoropolymers, and other materials with a surface energy preferably less than about 50 dynes/cm could be used to coat the masking plug 10. More preferably, the coating material has a surface energy in the range of about 18 dynes/cm to about 37 dynes/cm. Most preferably, the coating material has a surface energy in the range of about 18 dynes/cm to about 30 dynes/cm. The table below lists several plausible low surface energy materials suitable for the present invention. These materials are provided for explanation only, and are not limiting on the scope of the invention.

| Material | Substrate's dynes/cm |
|---|---|
| Kapton ® (Polymide) | 50 |
| Phenolic | 47 |
| Nylon | 46 |
| Alkyd Enamel | 45 |
| Polyester | 43 |
| Epoxy Paint | 43 |
| Polyurethane Paint | 43 |
| ABS | 42 |
| Polycarbonate | 42 |
| PVC (Polyvinyl Chloride) | 39 |
| Noryl ® | 38 |
| Acrylic | 38 |
| Polane ® Paint | 38 |
| PVA | 37 |
| Polystyrene | 36 |
| Acetal | 36 |
| EVA | 33 |
| Polyethylene | 31 |
| Polypropylene | 29 |
| Tedlar ® | 28 |
| Teflon ® | 18 |

Figure 1B:
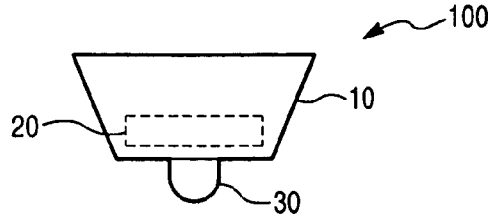
Figure 1C:
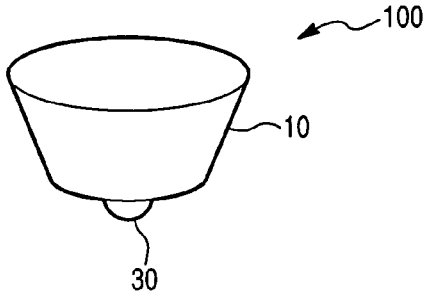
Figure 1D:
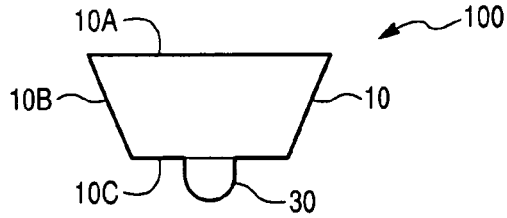

Preferably, the masking plug 10 comprises a rubber material coated with Teflon. As would be readily apparent to one skilled in the art, the masking plug 10 may be substantially coated on all surfaces, or may be coated on only some of the surfaces depending on the application. Thus, for example, masking plug 10 may only require a coating on top surface 10A and side surface 10B, with a substantially coating free bottom surface 10C (FIG. 1D).

The masking plug 10 further comprises a magnetic material 20. Preferably, the magnetic material 20 comprises a magnetic insert, such as a conventional magnet (FIG. 1B). Alternatively, the magnetic material 20 may be dispersed throughout the masking plug 10, or the masking device 100 may comprise a magnet coated with a material having a substantially low surface energy, thereby obviating a need for a separate magnetic material 20.

According to this first embodiment, the masking device 100 can be positioned on a substrate by aligning the protruding portion 30 with a deformation or orifice on the substrate. Preferably, the substrate comprises a metal material, such that the magnetic material 20 of the masking device 100 magnetically holds the masking device 100 on the substrate. A coating (e.g., a sprayable polyurethane bed liner) can then be applied to the substrate without applying any substantial amount of the coating in the deformation or orifice of the substrate effectively masked by the masking device 100. The masking device 100 can later be quickly and easily removed by simply applying enough force to overcome the magnetic hold, preferably after the applied coating has at least partially cured.

A masking device 100 according to this first embodiment thus has the advantage of being relatively easy to locate/apply on a substrate, and relatively easy to remove from the substrate after applying a coating to the substrate. Excess substrate coating can be easily removed from the masking plug 10 due, in part, to the material having a substantially low surface energy, thereby improving the reusability of the masking plug 10. Specifically, the low surface energy does not allow the coating to wet then bond to it, thus making removal of excess substrate coating relatively easy. The substantial prevention of wetting then bonding also improves removability of the masking plug 10 from the deformation or orifice by substantially preventing the masking plug 10 from being held in place by the applied coating. The improved removability of the masking plug 10 also advantageously leaves a substantially clean and predictable edge after being removed. A masking device 100 according to this first embodiment can also be removed after cure.

Figure 2:
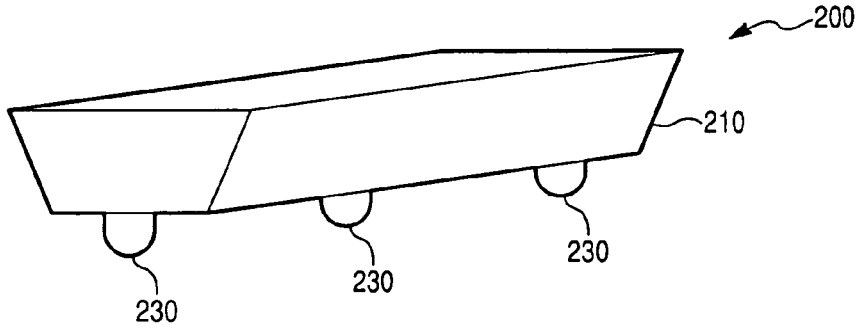
FIG. 2 is a perspective view of a masking device according to another embodiment of the present invention.

A second embodiment of the present invention is shown in the perspective view of FIG. 2. According to this second embodiment, a masking device 200 comprises a masking plug 210 and a plurality of protruding portions 230 for locating the masking plug 210 on a substrate with a plurality of orifices/depressions/etc. (not shown). Preferably, the masking device 200 includes a magnetic material and/or a material having a substantially low surface energy (not shown) as previously described with reference to FIG. 1.

Figure 5:
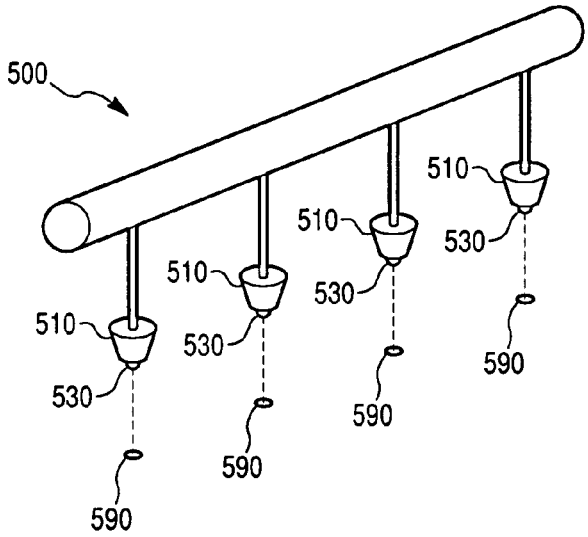
FIG. 5 is a perspective view of a masking device including a plurality of masking plugs according to another embodiment of the present invention.
Figure 6:
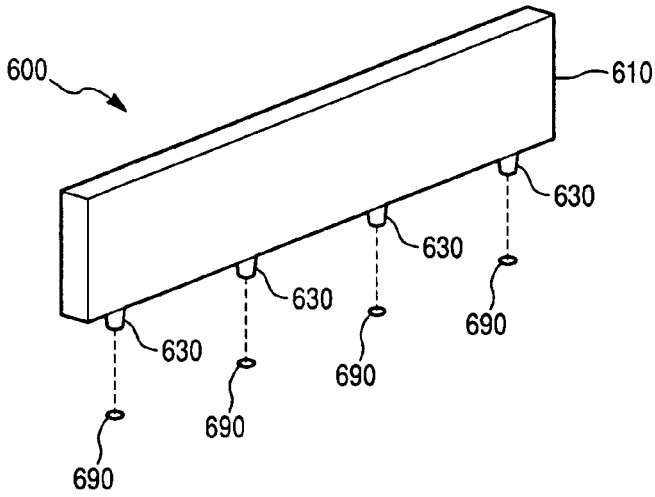
FIG. 6 is a perspective view of a masking device including a plurality of protruding portions according to another embodiment of the present invention.

As would be readily apparent to one skilled in the art after reading this disclosure, other configurations of masking plug 210 are also possible as shown, by way of example, in FIG. 5 and FIG. 6. As shown in FIG. 5, masking device 500 comprises a plurality of individual masking plugs 510 each including a protruding portion 530 for engaging an orifice 590 in a substrate. As similarly shown in FIG. 6, masking device 600 comprises a single base portion 610 with a plurality of protruding portions 630 for engaging a plurality of orifices 690 in a substrate. Depending on the particular orifice configuration, the plurality of protruding regions 530/630 may obviate the need for a magnetic insert to effectively hold the mask 500/600 on the substrate during application of a coating. Moreover, the plurality of protruding regions 530/630 facilitate masking of a plurality of holes simultaneously. Preferably, the bed liner material would then be sprayed below the top of the masking device 500/600 to minimize material buildup. As would be readily apparent to one skilled in the art, other variations and combinations thereof are plausible in view of the teachings of the present invention.

According to this second embodiment, the masking device 200 effectively masks a plurality of deformations or orifices in a substrate via the plurality of protruding portions 230. Thus, in addition to the aforementioned advantages of the first embodiment, a masking device 200 according to this second embodiment also provides a simple and low cost device for masking a plurality of deformations or orifices. Moreover, the masking device 200 further provides masking along an elongated region in the shape of the bottom surface of masking plug 210, such as along a substantially rectangular section (e.g., a channel or track) of a truck bed.

Figure 3:
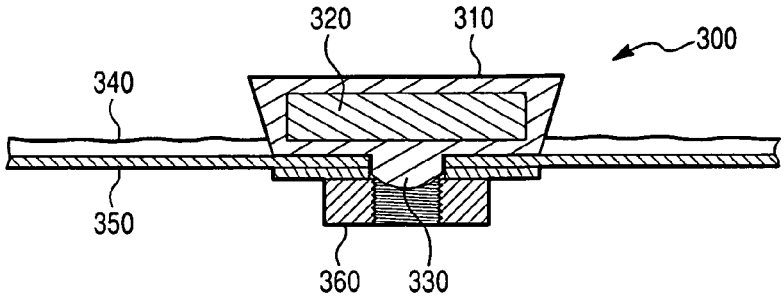
FIG. 3 is a cross sectional view of a masking device positioned on a sheet metal according to another embodiment of the present invention.

A third embodiment of the present invention is shown in the cross sectional view of FIG. 3. According to this third embodiment, masking device 300 is shown comprising a masking plug 310 including a magnetic material 320. As shown, a protruding portion 330 of the masking plug 310 protrudes into an orifice of sheet metal 350. The masking device 300 substantially prevents bed liner material 340 from entering the orifice of sheet metal 350. The orifice thus may be kept open so that, for example, a fastener can engage a weld nut 360. A masking device 300 according to this third embodiment has all of the aforementioned advantages of the first embodiment.

Figure 4A:
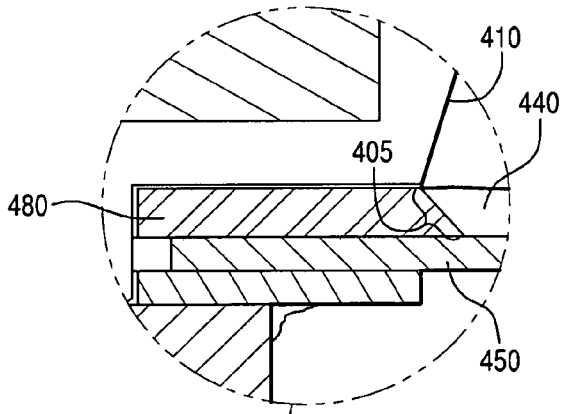
FIG. 4 is a cross sectional view of a masking device and a bushing retained by a bed liner material, with a portion of the masking device enlarged in FIGS. 4A-4C, according to another embodiment of the present invention.
Figure 4:
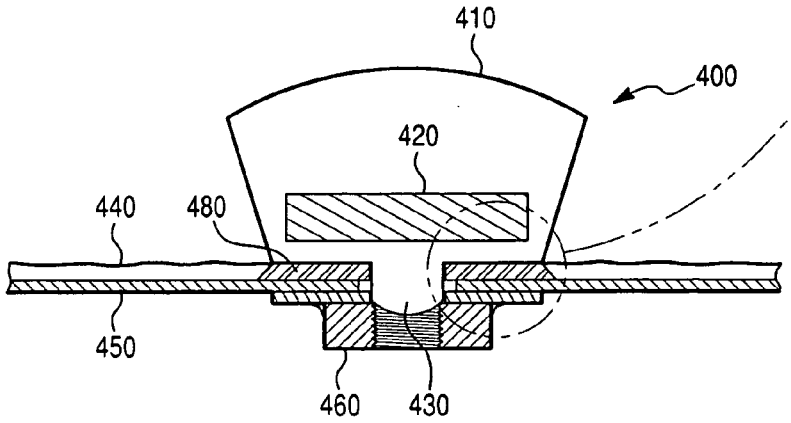

A fourth embodiment of the present invention is shown in the cross sectional view of FIG. 4. Masking device 400 comprises a masking plug 410 including a protruding portion 430 for engaging an orifice or deformation in bed sheet metal 450. Preferably, the masking device 400 includes a magnetic material 420 for magnetically holding the masking device 400 on the bed sheet metal 450 during application of a bed liner material 440.

Figure 4B:
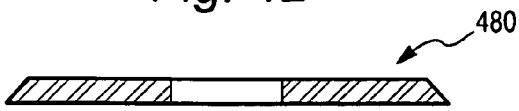
Figure 4C:
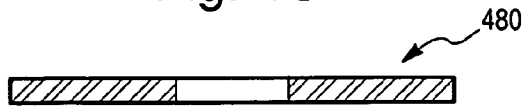

A masking device 400 according to this fourth embodiment has all of the advantages as described above with respect to FIG. 3 by keeping the orifice open for a fastener to engage weld nut 460/etc., and also provides for retaining a bushing 480 on the bed sheet metal 450 via the applied bed liner material 440. The masking plug 410 will be removed after the bed liner material 440 has cured. The bed liner material 440 effectively holds the bushing 480 on the bed sheet metal 450 via the overlap region 405. Alternative bushing/overlap configurations are shown in FIG. 4B and FIG. 4C. Moreover, the bushing 480 may comprise an elongated metal strip along a central groove, wherein the bed liner material 440 retains the elongated metal strip on the bed sheet material 450 along a central track. Thus, a masking device 400 according to this fourth embodiment has all of the advantages described above with respect to FIG. 3 and further provides a simple and inexpensive means for holding a bushing on a bed sheet metal 450.

Figure 7:
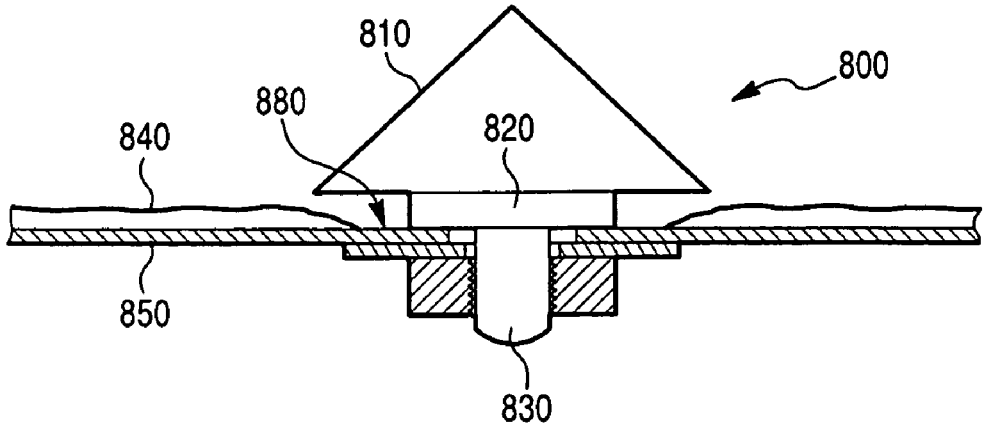
FIG. 7 is a cross sectional view of a masking device according to another embodiment of the present invention.

A fifth embodiment of the present invention is shown in the cross sectional view of FIG. 7. A masking device 800 according to this fifth embodiment is similar to the masking device 300 of FIG. 3, but includes a pointed masking plug 810. More specifically, the masking plug 810 shown may comprise a cone shaped masking plug (i.e., having a substantially circular base portion with narrowing to a tip as shown), a pyramid shaped masking plug (e.g., a three, four, five . . . sided pyramid), etc. As shown, the edge portion on the bottom of the masking plug 810 provides a "shadowed" area 880 (roughly corresponding in size to that of bushing 480 in FIG. 4) when the bed liner material 840 is being sprayed. This allows the material 840 to taper gradually from the full film thickness to a minimal (or zero) thickness. This gradual taper is beneficial in that it is less likely to lift at the interface between the material 840 and bed sheet metal 850. Also, because this tapered edge is formed without touching any portion of the masking device 800, when the masking device 800 is removed it will not lift the edge of the cured bed liner 840 from the surface of the bed 850, which reduces the possibility of delamination.

Also, as shown, the plug 810 may include a separate or integral magnetic portion 820 for magnetically attaching to the bed sheet metal 850, the plug 810 may include a magnetic insert as similarly shown in the masking device 300 of FIG. 3, or the plug may be free of a magnetic material (e.g., when used to plug a substantially horizontal surface). The protruding portion 830 then protrudes into the orifice from the bottom surface of the plug 810 or magnetic portion 820 (if provided).

Figure 8:
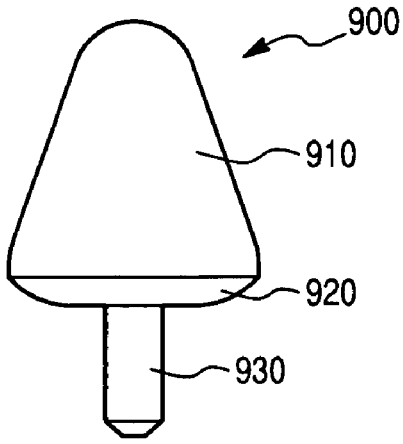
FIG. 8 is a side view of a masking device according to another embodiment of the present invention.

A sixth embodiment of the present invention is shown in the cross sectional view of FIG. 8. A masking device 900 according to this sixth embodiment is similar to the masking device 800 of FIG. 7, but includes a "mushroom" shaped masking plug 910. As shown, the plug 910 may include a tapered portion 920 (preferably magnetic) on a bottom portion of the plug 910. The protruding portion 930 then protrudes into the orifice from the bottom surface of the tapered portion 920.

A masking device 900 according to this sixth embodiment provides many of the advantages of the masking device 800, and may be easier to grasp for removal from the orifice due, in part, to the mushroom shape.

Figure 9A:
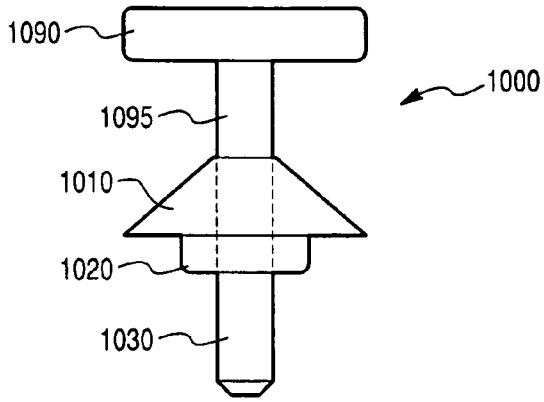
FIGS. 9A and 9B are views of a masking device according to another embodiment of the present invention.
Figure 9B:
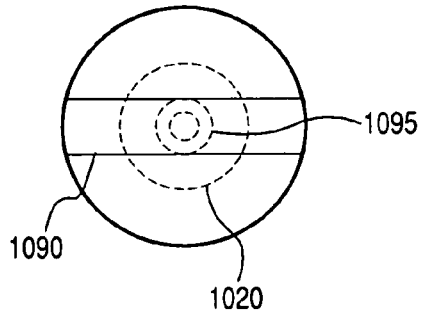

A seventh embodiment of the present invention is shown in the views of FIGS. 9A and 9B. A masking device 1000 according to this seventh embodiment includes a handle 1090 to facilitate easier removal of the masking device 1000 from an orifice. The handle 1090 may comprise a rectangular shape as shown in the top down view (FIG. 9B), or may comprise other shapes such as hexagonal, etc. The handle 1090 may be fixedly coupled to the plug 1010 as shown; e.g., by shaft 1095 or the like.

It should be appreciated that other aspects of the masking device 1000 are similar to those of previous embodiments. Hence, masking device 1000 may include a magnetic portion 1020, and a protruding portion 1030 as previously described. It should further be appreciated that other embodiments of the present invention may include a handle 1090 (preferably with shaft 1095) as in this seventh embodiment, if desired.

Figure 10A:
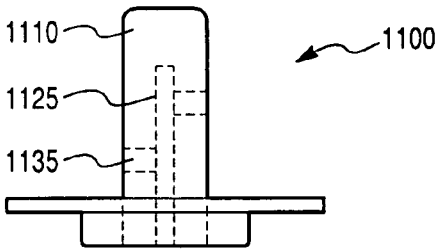
FIGS. 10A-10C are views of a masking device according to another embodiment of the present invention.
Figure 10C:
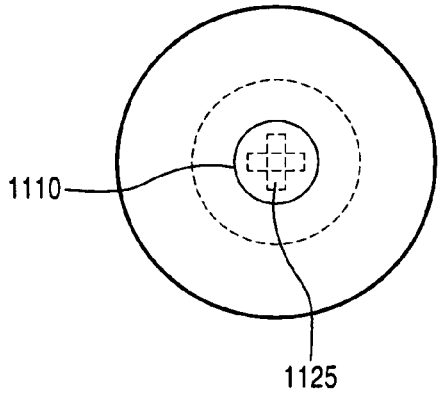
Figure 10B:
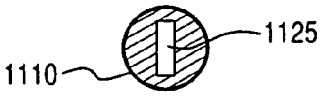
Figure 11A:
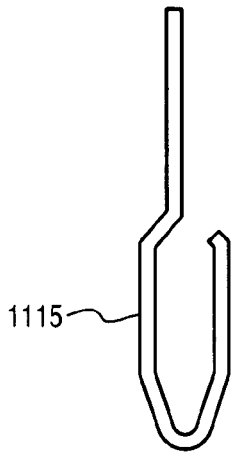
FIGS. 11A and 11B are views of a clip to be used with the masking device of FIGS. 10A-10C according to another embodiment of the present invention.
Figure 11B:
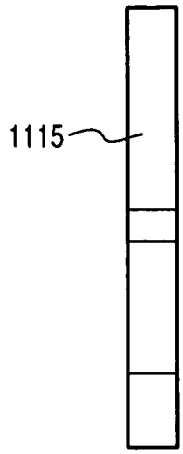

An eighth embodiment of the present invention is shown in the cross sectional views of FIGS. 10 and 11. A masking device 1100 according to this eighth embodiment preferably comprises a plug 1110 (FIG. 10) and separate clip 1115 (FIG. 11) coupled thereto. More specifically, as shown in FIG. 10, the plug 1110 preferably includes a channel 1125 (e.g., a bore or hole in plug 1110) adapted to receive the clip 1115, with one or more locking notches 1135 (e.g., for receiving a locking screw or the like). Alternatively, the plug 1110 and clip 1115 may be formed as one integral unit.

According to this eighth embodiment, the clip 1115 (FIG. 11) is adapted to clip into an orifice to temporarily "lock" the plug 1110 in place. Hence, the clip 1115 preferably comprises a pliable material, such as tempered/polished spring steel about 1.58 mm thick and about 4.76 mm wide. The clip 1115 and plug 1110 configuration of this eighth embodiment provide an alternate means for temporarily attaching to the bed sheet metal during a spraying operation without use of a magnetic insert or an interference fit between a protrusion and the orifice walls.

Figure 12A:
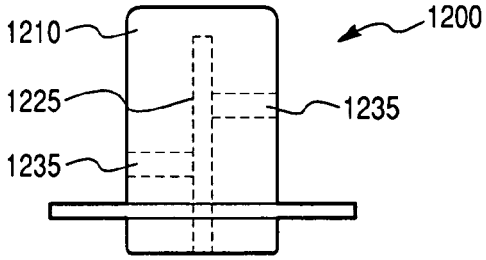
FIGS. 12A-12C are views of a masking device according to another embodiment of the present invention.
Figure 12C:
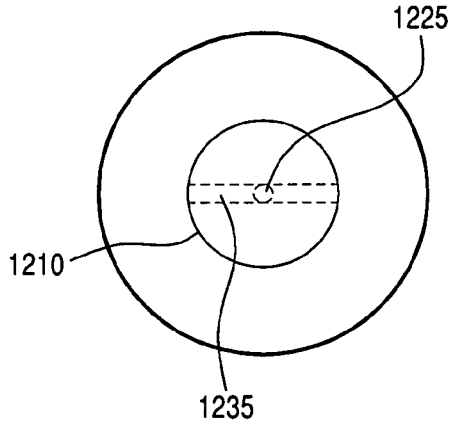
Figure 12B:
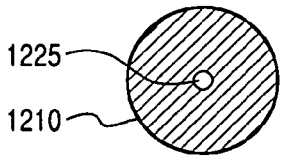
Figure 13A:
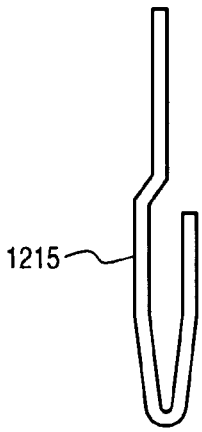
FIGS. 13A-13C are views of a clip to be used with the masking device of FIGS. 12A-12C according to another embodiment of the present invention.
Figure 13B:
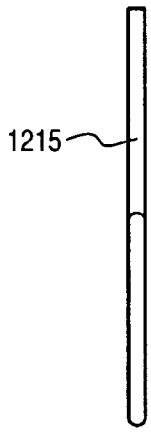
Figure 13C:
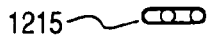

A ninth embodiment of the present invention is shown in the cross sectional view of FIGS. 12 and 13. A masking device 1200 according to this ninth embodiment preferably comprises a plug 1210 (FIG. 12) and a clip 1215 (FIG. 13) coupled thereto, similar to the plug 1110 and clip 1115 of FIGS. 10 and 11. More specifically, as shown in FIG. 12, the plug 1210 preferably includes a channel 1225 (e.g., a bore or hole within the plug 1210) adapted to receive the clip 1215 (FIG. 13), with one or more locking notches 1235 (e.g., for receiving a locking screw or the like).

Operation of the masking device 1200 is similar to that of masking device 1100, though the Figs. indicate variations thereon including, for example, a different sized plug 1210 and clip 1215.

Figure 14A:
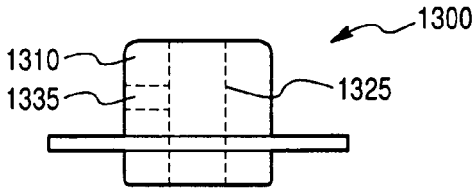
FIGS. 14A-14C are views of a masking device according to another embodiment of the present invention.
Figure 14C:
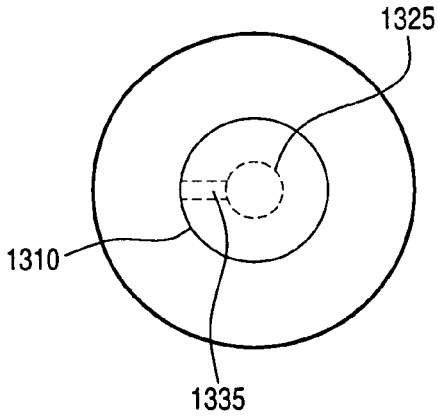
Figure 14B:
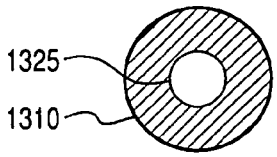

A tenth embodiment of the present invention is shown in the cross sectional views of FIG. 14. A masking device 1300 according to this tenth embodiment preferably comprises a plug 1310 (FIG. 14) and a clip (not shown) coupled thereto, similar to the plug 1110 of FIG. 10. More specifically, as shown, the plug 1310 preferably includes a channel 1325 (e.g., a bore or hole in plug 1310) adapted to receive the clip, with one or more locking notches 1335 (e.g., for receiving a locking screw or the like).

The clip according to this tenth embodiment preferably comprises a pass through quick-release pin (also known as faspins). Known quick-release pins typically comprises a self-locking pin with a spring-loaded ball that retracks when you push or pull the pin. Due to the configuration of known quick-release pins, the channel 1325 of masking device 1300 is depicted passing entirely therethrough in FIG. 14.

Operation of the masking device 1300 is similar to that of masking device 1100, though the Figs. indicate variations thereon including, for example, a different sized plug 1310.

Figure 15A:
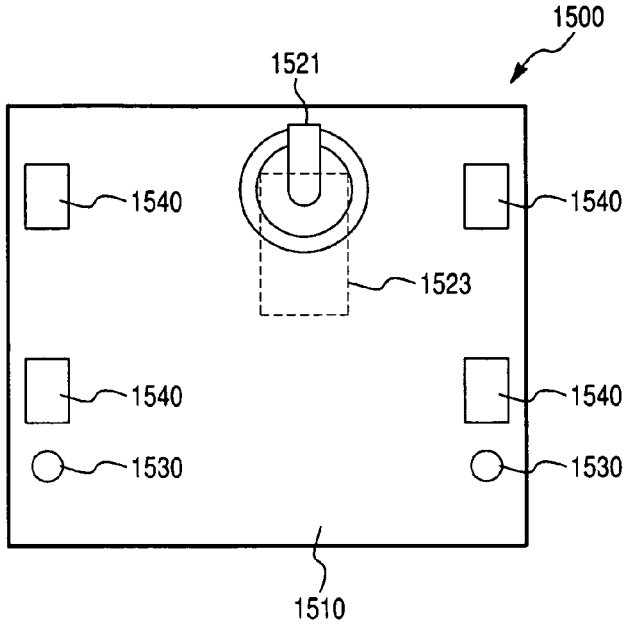
FIGS. 15A-15C are views of a wide bodied masking device according to another embodiment of the present invention.
Figure 15B:
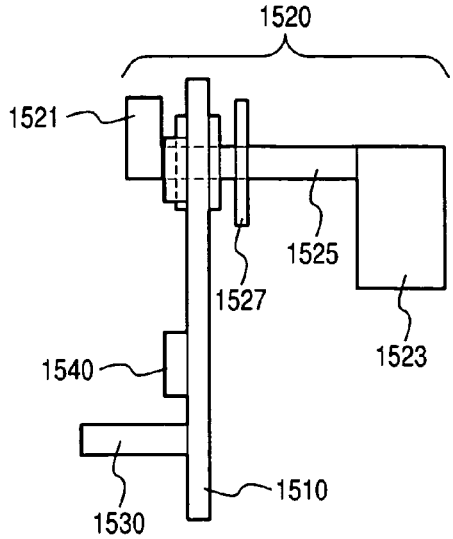
Figure 15C:
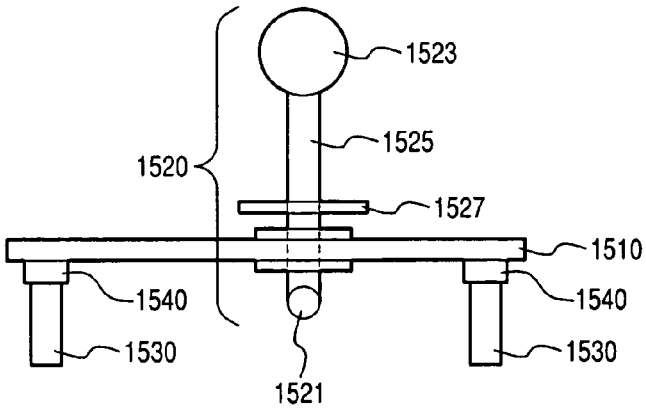

An eleventh embodiment of the present invention is shown in the views of FIG. 15. A masking device 1500 according to this eleventh embodiment preferably comprises a base portion 1510 (e.g., a metal plate) having a shape adapted to fit over a region to be masked. By way of example, the base portion 1510 shown is square shaped to mask a substantially square region on a base substrate (not shown). Hence, the base portion 1510 may take on alternative shapes (e.g., square, ovular, octagonal, etc.) depending on the particular region to be masked.

The masking device 1500 also includes a rotatable key lock 1520 adapted to lock the base portion 1510 to the substrate. The rotatable key lock 1520 includes a base portion 1521 adapted to rotate beneath the substrate so as to lock the masking device 1500 down on the substrate (and thus provide a locking surface underneath the substrate), a handle 1523 for rotating the base portion 1521, and a shaft 1525 coupling the base portion 1521 to the handle 1523. Preferably, the rotatable key lock 1520 also includes a shield 1527 for shielding a rotating portion of the rotatable key lock 1520 from sprayed bed liner material, such that the rotating portion is not contaminated with sprayed bed liner material.

In addition, the masking device 1500 may include one or more guide legs 1530 adapted to engage corresponding predrilled holes in the substrate such that the guide legs 1530 position the masking device 1500 on the substrate. The guide legs 1530 are shown in the bottom view of FIG. 16A and side views of FIGS. 16B and 16C projecting downward from the base portion 1510. It should be appreciated that the guide legs 1530 may be an integral part of the base portion 1510, or may be separable components (e.g., screw on legs) that can be changed depending on the particular guide hole dimensions to be interfaced with.

The masking device 1500 may also include one or more spacers 1540 for creating a gap between a bottom surface of the base portion 1510 and a top surface of the substrate on which the bed liner is to be sprayed. This creates a similar tapered edge as discussed in reference to the masking device 800.

In operation, the masking device 1500 is placed over a hole (with or without guide holes for guide legs 1530) into which the key lock 1520 is placed. The key lock 1520 is then rotated to lock the masking device 1500 down onto the substrate. Once the area is sprayed, the masking device 1500 can be easily removed by simply rotating the key lock 1520 into a release position.

This masking device 1500 thus has advantages similar to those of previously described embodiments, and also provides for a larger masking area. Hence, the area around an orifice can be kept free of bed liner material for attaching (e.g., by welding) additional components, such as, tool boxes, etc.

Thus, sprayable bed liners and methods of manufacturing the same have been described according to various aspects of the present invention. Moreover, an improved masking device can be achieved by combining the teachings of various embodiments of the present invention.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application and to enable one skilled in the art to utilize the invention in various embodiments and with various modifications as are suited to the particular use contemplated. It is intended that the scope of the invention be defined by the claims appended hereto, and their equivalents.

What is claimed is:

1. A method of manufacturing a bed liner for a truck bed, comprising:

providing a truck bed;

applying a masking device to an orifice in the truck bed;

retaining the masking device in the orifice by inserting a portion of the masking device into the orifice, wherein the orifice includes a nut associated therewith and the portion of the masking device is inserted into the nut, and the portion of the masking device inserted into the nut is a clip;

applying a coating of truck bed liner material to the truck bed; and removing the masking device, wherein, after removing the masking device, a region of the truck bed surrounding the orifice is free of the truck bed liner material.

2. The method according to 1, wherein the masking device includes an overhang portion extending outwardly therefrom to form a shadowed area on the truck bed when the masking device is retained, and wherein when the truck bed liner material is applied, a tapered edge is formed in the shadowed area.

3. The method according to 2, wherein the tapered edge is from full thickness of the bed liner to zero thickness of the bed liner.

4. The method according to 2, wherein the overhang portion has a circular periphery.

5. A method of manufacturing a truck bed for a vehicle, the truck bed comprising an orifice, the method comprising:

positioning a masking plug including an engagement member relative to the truck bed, wherein the engagement member is releasably inserted into the orifice to retain the masking plug on the truck bed;

applying a sprayable bed liner material onto the truck bed; and after the applied sprayable bed liner material has at least partially cured, removing the masking plug from the truck bed, wherein the masking plug includes a bottom surface configured to mask an area of the truck bed proximal to the orifice to form an area free of the sprayable bed liner material after removing the masking plug, wherein the masking plug includes an overhang portion spaced apart from the bottom surface and configured to form a shadowed area of the truck bed surrounding the area free of the sprayable bed liner material, wherein when the sprayable bed liner material is applied, a tapered edge is formed in the shadowed area, and wherein the engagement member is a clip extending from the bottom surface of the masking plug, the clip being selectively deformable to engage a weld nut associated with the orifice.

6. The method according to 5, wherein the bottom surface has a circular periphery.

7. The method according to 5, wherein the overhang portion has a circular periphery.

8. The method according to 5, wherein the engagement member is a protruding portion extending from the bottom surface of the masking plug, the protruding portion having an end portion at a distal end thereof and a central portion, the central portion having a substantially constant cross section along the length thereof.

9. The method according to 8, wherein the protruding portion extends perpendicular to the bottom surface of the masking plug.

10. The method according to claim 5, wherein the clip is generally U-shaped.

11. The method according to claim 5, wherein the clip is formed of a spring steel.

* * * * *